US008837987B2

(12) United States Patent
Sumita

(10) Patent No.: US 8,837,987 B2
(45) Date of Patent: Sep. 16, 2014

(54) IMAGE FORMING APPARATUS WITH FIRST AND SECOND INTERLOCKING DOORS

(75) Inventor: Takuya Sumita, Okazaki (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 176 days.

(21) Appl. No.: 13/418,858

(22) Filed: Mar. 13, 2012

(65) Prior Publication Data

US 2012/0237258 A1 Sep. 20, 2012

(30) Foreign Application Priority Data

Mar. 18, 2011 (JP) ..... 2011-060271

(51) Int. Cl.
*G03G 21/00* (2006.01)

(52) U.S. Cl.
USPC ..... 399/124

(58) Field of Classification Search
USPC ..... 399/121, 124
IPC ..... G03G 21/1633,21/1638, 2221/1687, G03G 2221/169
See application file for complete search history.

(56) References Cited

U.S. PATENT DOCUMENTS

| | | | | |
|---|---|---|---|---|
| 7,317,887 | B2 * | 1/2008 | Otaka | 399/124 |
| 7,551,873 | B2 * | 6/2009 | Hiura | 399/107 |
| 2010/0329738 | A1 * | 12/2010 | Shirai | 399/124 |
| 2011/0293326 | A1 * | 12/2011 | Tanabe et al. | 399/124 |

FOREIGN PATENT DOCUMENTS

| | | | |
|---|---|---|---|
| JP | 1-092135 A | | 4/1989 |
| JP | 4-007227 A | | 1/1992 |
| JP | 11084983 A | * | 3/1999 |
| JP | 2005-330067 A | | 12/2005 |
| JP | 2008-216595 A | | 9/2008 |
| JP | 2010054881 A | * | 3/2010 |

OTHER PUBLICATIONS

Office Action (Notification of Reasons for Refusal) dated Mar. 5, 2013, issued in corresponding Japanese Patent Application No. 2011-060271, and an English Translation of the Office Action. (9 pages).

* cited by examiner

*Primary Examiner* — Robert Beatty
(74) *Attorney, Agent, or Firm* — Buchanan Ingersoll & Rooney PC

(57) ABSTRACT

An image forming apparatus having: a guide that is a component of a conveyance route for a print medium; a first door that incorporates the guide, an inside of the conveyance route being exposed to an outside of a main body of the image forming apparatus when the first door is open; a functional component fixed to the first door, the functional component being placed in a specified position by contact with a component located inside the main body when the first door is closed; a first lock mechanism for keeping the first door closed; a second door that covers the first door when the second door is closed and that exposes the first door to the outside of the main body when the second door is open; and a second lock mechanism for keeping the second door closed.

5 Claims, 8 Drawing Sheets

REAR
FRONT

⊗ LOWER
⊙ UPPER

LEFT RIGHT

IMAGE FORMING APPARATUS WITH FIRST AND SECOND INTERLOCKING DOORS

This application is based on Japanese Patent Application No. 2011-060271 filed on Mar. 18, 2011, the content of which is incorporated herein by reference.

BACKGROUND OF THE INVENTION

The present invention relates to an image forming apparatus, and more particularly to an image forming apparatus for forming an image on a print medium.

An example of conventional image forming apparatuses is an image forming apparatus provided with a sheet conveying device as disclosed by Japanese Patent Laid-Open Publication No. 4-7227. The sheet conveying device disclosed by Japanese Patent Laid-Open Publication No. 4-7227 includes a guide that is a component of a sheet conveyance route, and the guide can be open and closed. A door, which can be open and closed, is attached to the outside of the guide. The guide and the door are connected to each other by a linking device, and thereby, the guide is put open and closed simultaneously with the opening/closing motion of the door. One of a pair of conveyer rollers, that is, one of two mutually opposed rollers is placed on the guide. When the guide is closed, the two rollers are pressed against each other. In the sheet conveying device, since the door and the guide are put open and closed simultaneously with each other, a paper jam can be easily cleared up.

However, in the sheet conveying device disclosed by Japanese Patent Laid-Open Publication No. 4-7227, it is difficult to position the two rollers accurately, and accordingly, it is difficult to permit the two rollers to be pressed against each other accurately. This is described in more detail. As mentioned above, one of the two rollers is placed on the guide, and the roller placed on the guide is pressed against the other of the two rollers. Therefore, the guide receives force via the roller placed thereon. Then, since the guide is pushed and closed by the door, the force applied to the guide is transmitted to the door. In a recent image forming apparatus, the door is made thin, and therefore, the door is deformable by force. The deformation of the door causes displacement of the guide, which results in displacement of the roller placed on the guide.

SUMMARY OF THE INVENTION

An image forming apparatus according to an embodiment of the present invention comprises: a guide that is a component of a conveyance route for a print medium; a first door that incorporates the guide, an inside of the conveyance route being exposed to an outside of a main body of the image forming apparatus when the first door is open; a functional component fixed to the first door, the functional component being placed in a specified position by contact with a component located inside the main body when the first door is closed; a first lock mechanism for keeping the first door closed; a second door that covers the first door when the second door is closed and that exposes the first door to the outside of the main body when the second door is open; and a second lock mechanism for keeping the second door closed; wherein a closing motion of the second door in a state wherein both the first door and the second door are open activates the second lock mechanism and the first lock mechanism, whereby the first door is put closed.

BRIEF DESCRIPTION OF THE DRAWINGS

This and other features of the present invention will be apparent from the following description with reference to the accompanying drawings, in which.

DETAILED DESCRIPTION OF THE PREFERRED EMBODIMENTS

An image forming apparatus according to an embodiment of the present invention will be hereinafter described.

Structure of the Image Forming Apparatus

Figure 1:
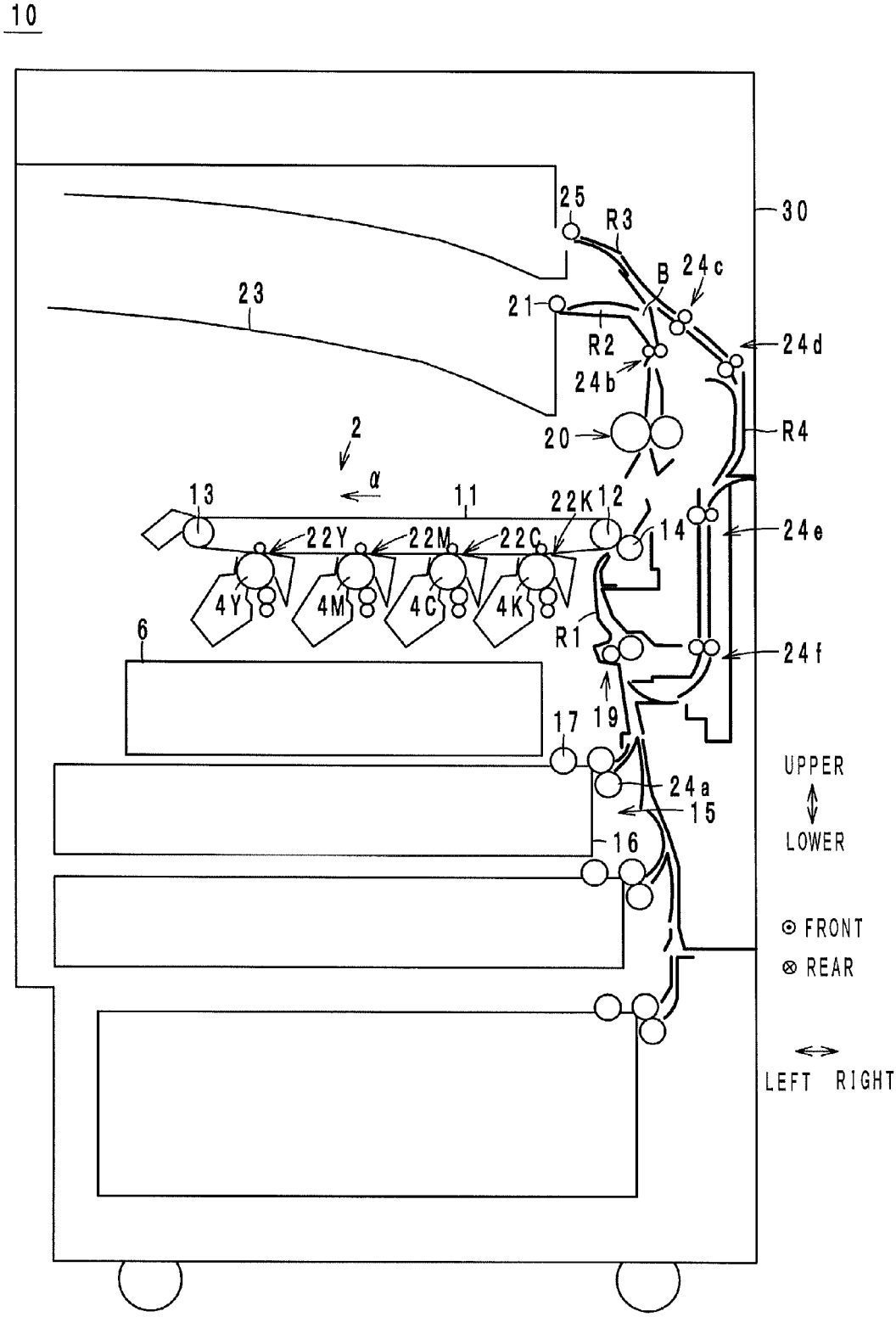
FIG. 1 is a skeleton framework of an image forming apparatus.

An image forming apparatus provided with a sheet conveying device according to an embodiment of the present invention is described with reference to the accompanying drawings. FIG. 1 shows the overall structure of the image forming apparatus 10. In the following paragraphs, the words, "right" and "left" mean respectively the right and the left on the plane of FIG. 1. The words, "upward", "downward", "upper" and "lower" are used with respect to the vertical direction on the plane of FIG. 1. The words, "front" and "rear" are used with respect to the direction perpendicular to the plane of FIG. 1.

The image forming apparatus 10 is an electrophotographic color printer and combines images of four colors, namely, yellow (Y), magenta (M), cyan (C) and black (K) by a tandem method. The image forming apparatus 10 forms an image on a sheet in accordance with image data read with a scanner. As shown by FIG. 1, the image forming apparatus 10 comprises a printing section 2, a feeding section 15, a pair of timing rollers 19, a fixing device 20, a pair of ejection rollers 21, a printed-sheet tray 23, pairs of conveyer rollers 24*a* to 24*f*, a pair of reversing rollers 25, a main body 30 and sheet conveyance routes R1 to R4.

The main body 30 is a case that encloses the printing section 2, the feeding section 15, the pair of timing rollers 19, the fixing device 20, the pair of ejection rollers 21, the printed-sheet tray 23, the pairs of conveyer rollers 24*a* to 24*f*, the pair of reversing rollers 25 and the sheet conveyance routes R1 to R4.

The feeding section 15 feeds sheets of a print medium P one by one. The feeding section 15 comprises a sheet tray 16 and a feed roller 17. On the sheet tray 16, a plurality of sheets P to be subjected to printing are stacked. The feed roller 17 picks up one sheet from the stack of sheets P on the sheet tray 16.

The sheet P picked up by the feed roller 17 is conveyed upward by the pair of conveyer rollers 24*a*. The pair of timing rollers 19 feeds the sheet P further upward in synchronized timing so that a toner image can be transferred onto the sheet P at the printing section 2.

The printing section 2 forms a toner image on the sheet P fed from the feeding section 15. The printing section 2 comprises an optical scanning device 6, an intermediate transfer belt 11, a driving roller 12, a driven roller 13, a secondary transfer roller 14 and image formation units 22 (22Y, 22M, 22C, 22K). The image formation units 22 (22Y, 22M, 22C, 22K) each have a photosensitive drum 4 (4Y, 4M, 4C, 4K).

The photosensitive drums 4 (4Y, 4M, 4C, 4K) are cylindrical. The peripheral surfaces of the photosensitive drums 4 are scanned with beams from the optical scanning device 6, and thereby, electrostatic latent images are formed on the peripheral surfaces of the photosensitive drums 4. Thereafter, the electrostatic latent images are developed into toner images by developing devices (not shown). Since the process of forming an electrostatic latent image and the process of developing the electrostatic latent image into a toner image are well known, and a detailed description thereof is omitted.

The intermediate transfer belt 11 is stretched between the driving roller 12 and the driven roller 13. The toner images formed on the photosensitive drums 4 are transferred and combined on the intermediate transfer belt 11 to be formed into a composite toner image (primary transfer). The driving roller 12 is rotated by an intermediate transfer belt driving section (not shown) and drives the intermediate transfer belt 11 in a direction shown by arrow α. Thereby, the intermediate transfer belt 11 carries the composite toner image to the secondary transfer roller 14.

The secondary transfer roller 14, which is cylindrical, is located in such a position to face to the intermediate transfer roller 11. A transfer voltage is applied to the secondary transfer roller 14, and thereby, the composite toner image carried by the intermediate transfer belt 11 is transferred onto a sheet P passing through between the intermediate transfer belt 11 and the secondary transfer roller 14 (secondary transfer).

The sheet P with the toner image transferred thereon is fed to the fixing device 20. The fixing device 20 performs a heating treatment and a pressing treatment toward the sheet P, and thereby, the toner image is fixed on the sheet P. Thereafter, the sheet P is conveyed to the pair of ejection rollers 21 by the pair of conveyer rollers 21, and is ejected onto the printed-sheet tray 23 by the pair of ejection rollers 21.

The image forming apparatus 10 is of a structure for permitting double-side printing of a sheet P. More specifically, for double-side printing, the image forming apparatus 10 performs printing on one side of a sheet P, reverses the sheet P and performs printing on the other side of the sheet P.

In the image forming apparatus 10, the conveyance route R1 is from the feeding section 15 to a diverging point B immediately downstream from the pair of conveyer rollers 24*b* with respect to the sheet conveyance direction. The conveyance route R1 is formed of guides (shown by heavy lines in FIG. 1). On the conveyance route R1, the pair of conveyer rollers 24*a*, the pair of timing rollers 19, the printing section 2, the fixing device 20 and the pair of conveyer rollers 24*b* are arranged in this order from upstream to downstream with respect to the sheet conveyance direction. The conveyance routes R2 and R3 branch off from the conveyance route R1 at the diverging point B.

The conveyance route R2 is from the diverging point B to the pair of ejection rollers 21. The conveyance route R2 is formed of guides (shown by heavy lines in FIG. 1). On the conveyance route R2, the pair of ejection rollers 21 is arranged.

The conveyance route R3 extends from the diverging point B more upward than the conveyance route R2. The conveyance route R3 is formed of guides (shown by heavy lines in FIG. 1). On the conveyance route R3, the pair of reversing rollers 25 is arranged. The pair of reversing rollers 25 feeds the sheet P fed through the conveyance routes R1 and R3 outward from the main body 30, and feeds the sheet P back into the main body 30. Thereby, the traveling direction of the sheet P is reversed, and the sheet P is fed back into the conveyance route R4.

The conveyance route R4 is connected with the conveyance route R3 at the diverging point B, and the conveyance route 4 is formed of guides (shown by heavy lines in FIG. 1). On the conveyance route R4, the pairs of conveyance rollers 24*c* to 24*f* are arranged in this order from upstream to downstream with respect to the sheet conveyance direction. The pairs of conveyance rollers 24*c* and 24*f* convey the sheet P to the conveyance route R1.

Now, a process of conveying a sheet P for double-printing is described. While the sheet P is traveling in the conveyance route R1, a toner image is transferred onto a first side of the sheet P at the printing section 2 (secondary transfer), and the toner image is fixed onto the first side of the sheet P by the fixing device 20. Thereafter, the sheet P is conveyed into the conveyance route R3. In the conveyance route R3, the sheet P is once fed outward from the main body 30 and is fed back into the conveyance route R4. Then, while the sheet P is traveling in the conveyance route R4 to the conveyance route R1, the sheet P is turned over. Thereafter, while the sheet P is traveling in the conveyance route R1, a toner image is transferred onto a second side of the sheet P at the printing section 2, and the toner image is fixed onto the second side of the sheet P by the fixing device 20. Then, the sheet P is conveyed in the conveyance route R2 and is ejected onto the printed-sheet tray 23 by the pair of ejection rollers 23.

Structure of the Doors

Figure 2:
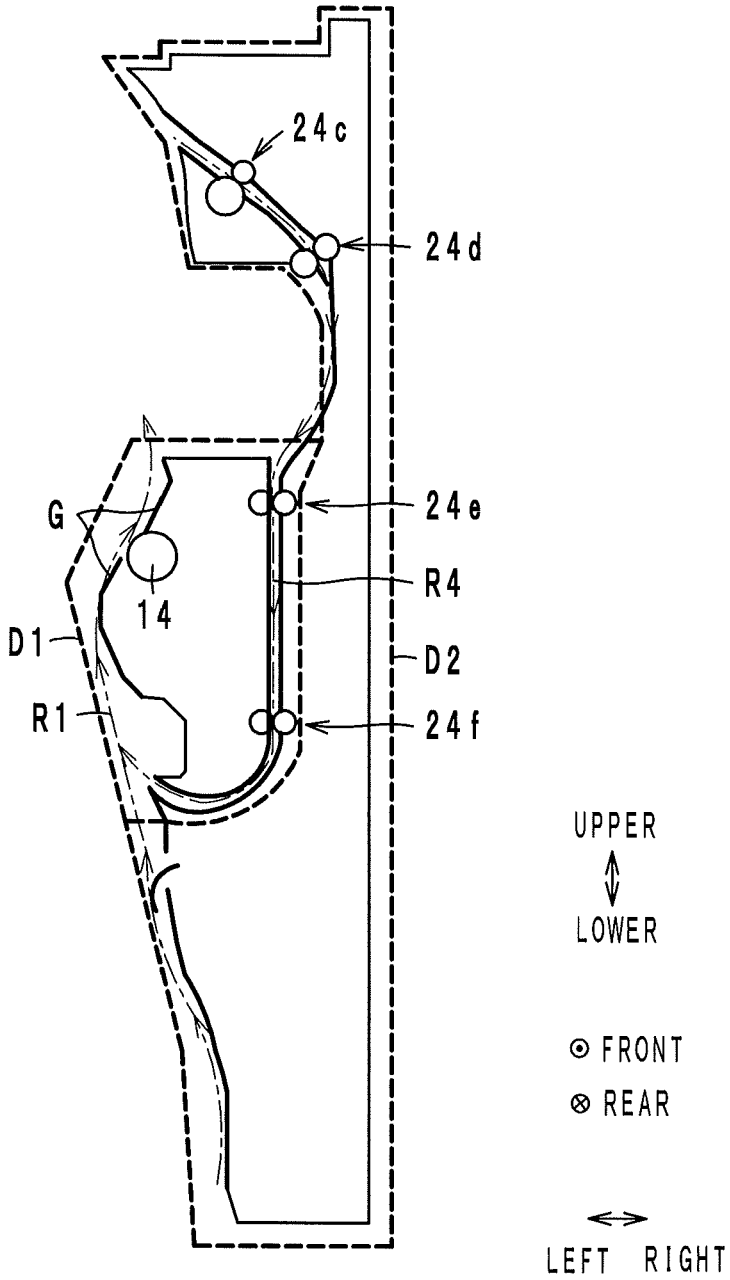
FIG. 2 is an enlarged view of a sheet conveyance route and the vicinity thereof.
Figure 3:
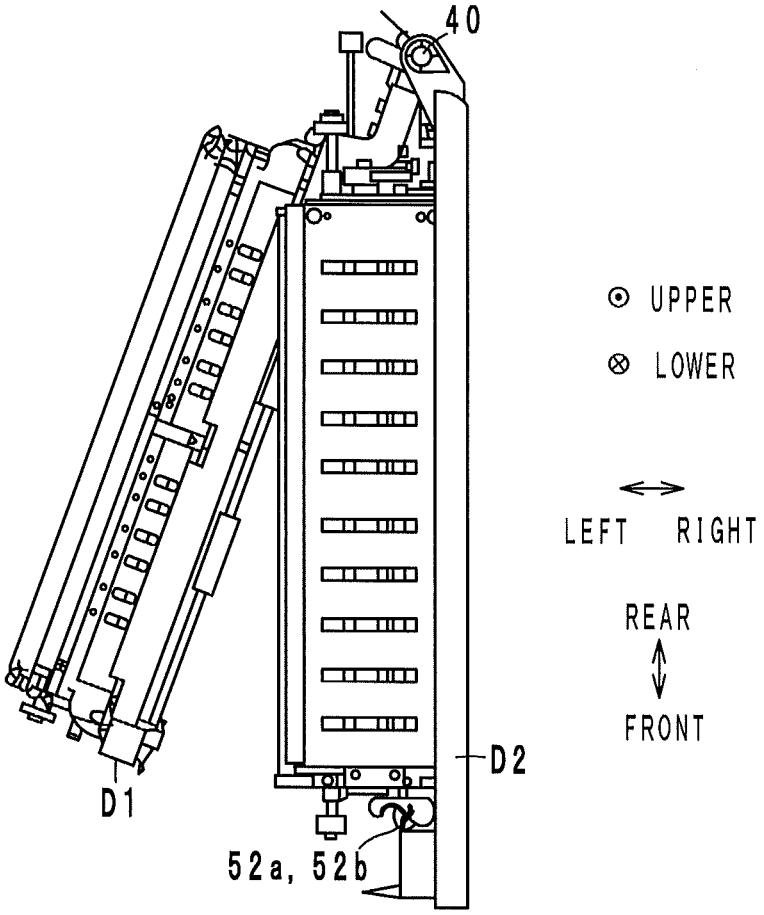
FIG. 3 is a top view of doors.
Figure 4:
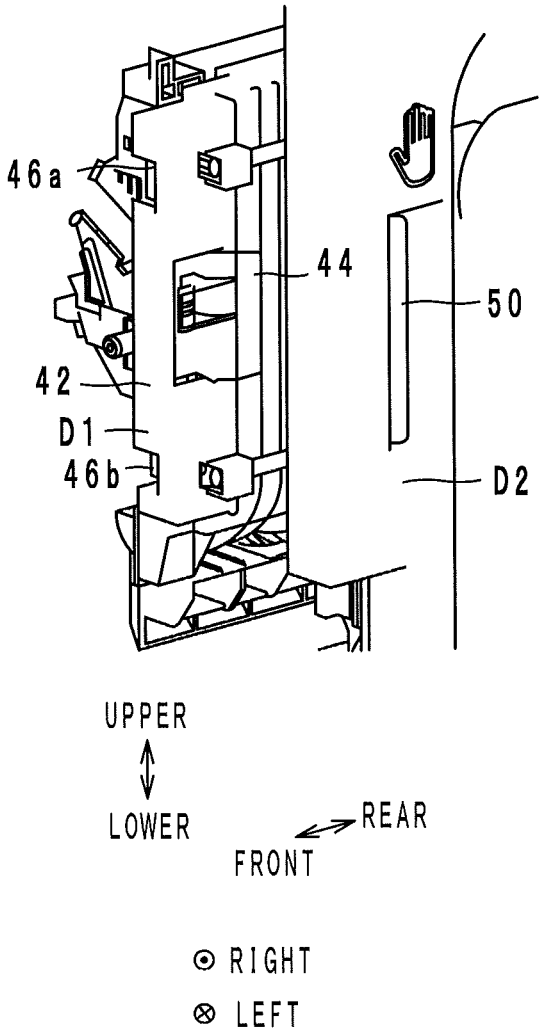
FIG. 4 is a perspective view of the doors.
Figure 5:
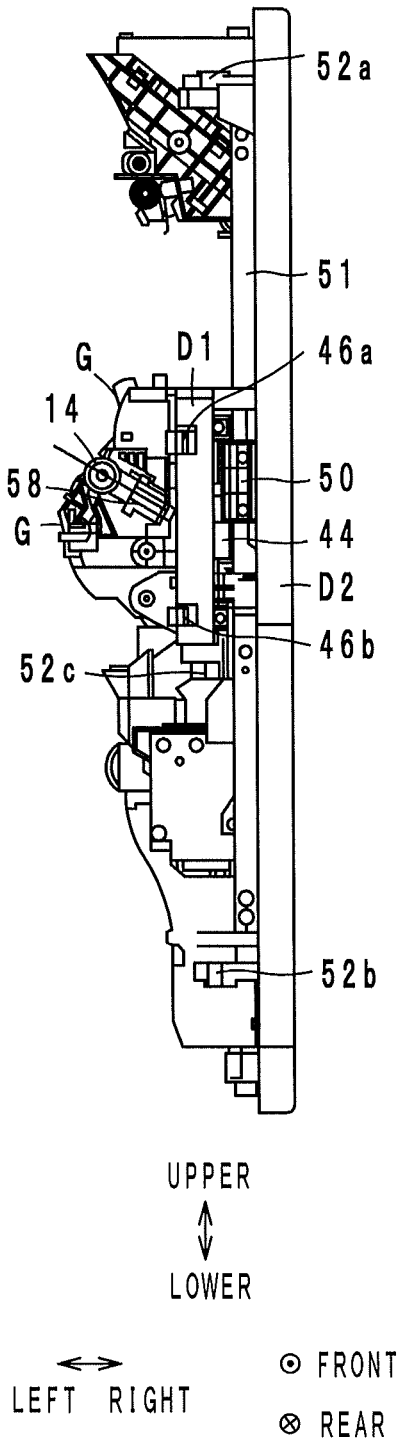
FIG. 5 is a detail view of the doors.

The image forming apparatus 10 has doors on the right side of the main body 30, and a user can get access to the inside of the main body 30 for clear-up of a sheet jam by opening the doors. Now, the structure of the doors is described. FIG. 2 is an enlarged view of the conveyance routes R1 and R4 of the image forming apparatus 10 and the vicinity thereof. FIG. 3 is a top view of the doors D1 and D2. FIG. 4 is a perspective view of the doors D1 and D2. FIG. 5 is a detail view of the doors D1 and D2.

The door D1 has a guide G (see FIG. 2) that is a component of the conveyance route R1 in the main body 30. Therefore, when the door D1 is open, the conveyance route R1 is open to the outside of the main body 30. More specifically, the door D1 is capable of pivoting on a shaft 40 that is located at the rear end of the main body 30 to extend in the vertical direction. As shown in FIG. 2, the left side of the door D1 serves as the guide G, which works as a part of the right side of the conveyance route R. In this structure, when the door D1 pivots counterclockwise on the shaft 40 viewed from the upper side to become open, the guide G separates form the conveyance route R1 together with the door D1, and accordingly, the inside of the conveyance route R1 becomes open to the outside of the main body 30.

The door D2 covers the door D1 when the door D2 is closed and exposes the door D1 to the outside of the main body 30 when the door D2 is open. More specifically, the door D1 is capable of pivoting on the shaft 40 that is located at the rear end of the main body 30 to extend in the vertical direction. As shown by FIGS. 2 and 3, the door D2 is larger than the door D1 and is located at a more outer portion (at the right side) of the main body 30 than the door D1. Thereby, when the door D2 is closed, the door D1 is covered by the door D2, and when the door D2 is open, the door D1 is uncovered. When the door D1 becomes open while the door D2 is open, the inside of the conveyance route R1 is exposed to the outside of the main body 30.

The secondary transfer roller 14 is fixed to the door D1 as shown in FIGS. 2 and 5. As shown in FIG. 1, the second transfer roller 14 is a functional component that is placed in a specified position by contact with the intermediate transfer belt 11 provided in the main body 30 while the door D1 is closed. More specifically, the secondary roller 14 is fixed to the left side of the door D1, and the secondary roller 14 is pressed left upward by a presser 58 (see FIG. 5) incorporating an elastic member. Therefore, when the door D1 is closed, as shown in FIG. 1, the secondary roller 14 is pressed against the portion of the intermediate transfer belt 11 wound around the driving roller 12.

Figure 6:
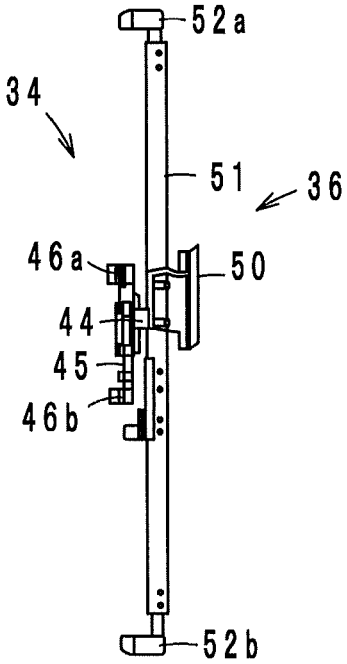
FIG. 6 is a perspective view of lock mechanisms.
Figure 7A:
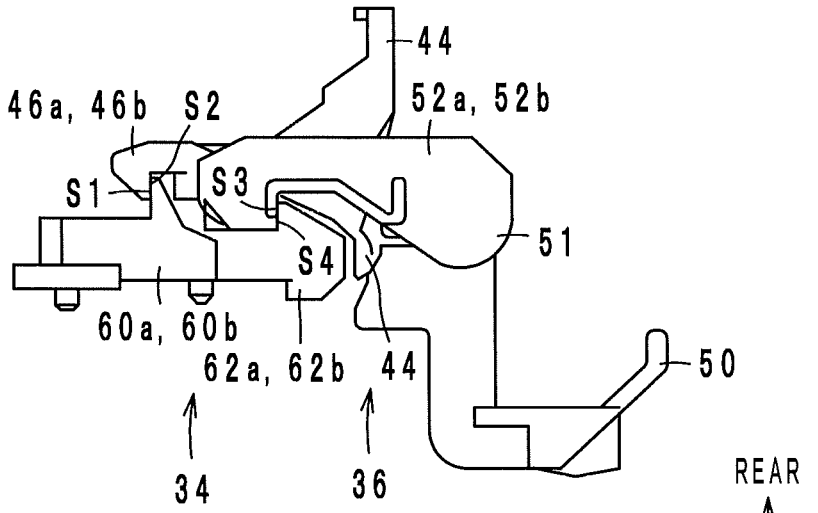
FIGS. 7*a* and 7*b* are top views of the lock mechanisms, FIG. 7*a* showing the lock mechanisms in locking states and FIG. 7*b* showing the lock mechanisms in unlocking states.
Figure 7B:
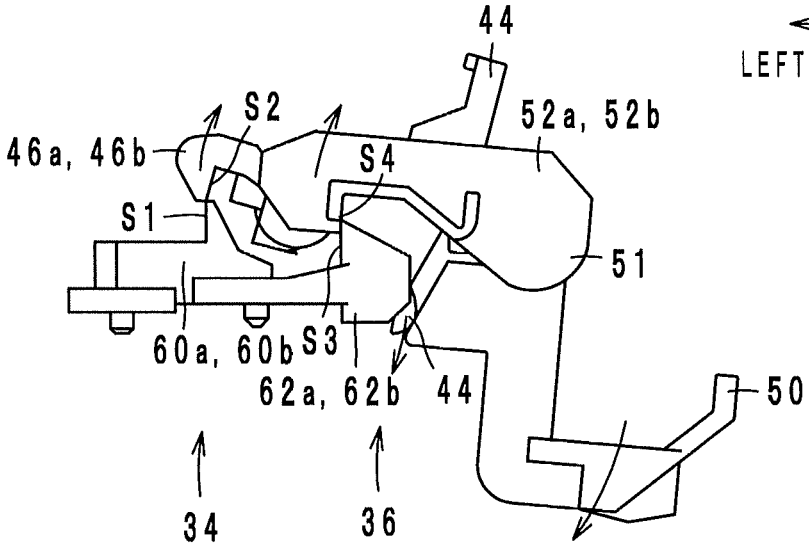

Further, the image forming apparatus 10 has lock mechanisms 34 and 36 for locking the doors D1 and D2 in the closed positions. Next, the lock mechanisms 34 and 36 are described. FIG. 6 is a perspective view of the doors D1 and D2. FIG. 7*a* is a top view of the lock mechanisms 34 and 36 in locking states, and FIG. 7*b* is a top view of the lock mechanisms 34 and 36 in unlocking states.

The lock mechanism 34 is to lock the door D1 in the closed position. As shown by FIGS. 5 to 7, the lock mechanism 34 comprises a lever 44, a link 45, catching parts 46*a* and 46*b*, and catching parts 60*a* and 60*b*. The catching parts 60*a* and 60*b* are claws formed in the main body 30. More specifically, as shown by FIGS. 7*a* and 7*b*, each of the catching parts 60*a* and 60*b* is a projection having a left-facing surface S1 and projecting to the rear. The catching parts 60*a* and 60*b* are of the identical shape, and are located in the same place viewed from the upper side. The catching part 60*a* is located above the catching part 60*b*.

As shown in FIG. 6, the link 45 is a stick-like member extending in the vertical direction, and is placed along the front side of the door D1. The link 45 is capable of pivoting on a shaft extending in the vertical direction.

As shown by FIGS. 4 to 6, the catching parts 46*a* and 46*b* are fitted to the door D1, and as shown by FIG. 7*a*, when the door D1 is closed (when the lock mechanism 34 is in a locking state), the catching parts 46*a* and 46*b* engage with the catching parts 60*a* and 60*b*, respectively. As shown in FIGS. 7*a* and 7*b*, each of the catching parts 46*a* and 46*b* is a projection having a right-facing surface S2 and projecting to the front. The catching parts 46*a* and 46*b* are of the identical shape, and are located in the same place viewed from the upper side. The catching parts 46*a* and 46*b* are located respectively at the upper end and at the lower end of the link 45. When the lock mechanism 34 is in the locking state, as shown by FIG. 7*a*, the catching parts 46*a* and 46*b* are located in the rear of the catching parts 60*a* and 60*b* with the right-facing surfaces S2 in contact with the left-facing surfaces S1 of the catching parts 60*a* and 60*b*. In this state, the catching parts 46*a*, 46*b*, 60*a* and 60*b* prevent the door D1 from pivoting counterclockwise on the shaft 40 (see FIG. 3), that is, keep the door D1 closed.

The lever 44 is a handle for disengagement of the catching parts 46*a* and 46*b* from the catching parts 60*a* and 60*b*. As shown in FIG. 6, the lever 44 is located in the center of the link 45 with respect to the vertical direction, and as shown in FIG. 4, the lever 44 is fixed to the right side (the outer side) of the door D1. As shown by FIG. 7*b*, when a user turns the lever 44 clockwise, the link 45 pivots clockwise. Accordingly, the catching parts 46*a* and 46*b* pivot clockwise on the link 45, and the right-facing surfaces S2 of the catching parts 46*a* and 46*b* separate from the left-facing surfaces S1 of the catching parts 60*a* and 60*b*. Thereby, the lock mechanism 34 becomes in an unlocking state, and it becomes possible to open the door D1.

The lock mechanism 36 is to lock the door D2 in the closed position. As shown by FIGS. 5, 6 and 7, the lock mechanism 36 comprises a lever 50, a link 51, catching parts 52*a* and 52*b*, and catching parts 62*a* and 62*b*. The catching parts 62*a* and 62*b* are claws formed in the main body 30. More specifically, as shown by FIGS. 7*a* and 7*b*, each of the catching parts 62*a* and 62*b* is a projection having a left-facing surface S3 and projecting to the rear. The catching parts 62*a* and 62*b* are of the identical shape, and are located in the same place viewed from the upper side. The catching part 62*a* is located above the catching part 62*b*.

As shown in FIG. 5, the link 51 is a stick-like member extending in the vertical direction, and is placed along the front side of the door D2. The link 51 is capable of pivoting on a shaft extending in the vertical direction.

As shown by FIGS. 4 to 6, the catching parts 52*a* and 52*b* are fitted to the door D2, and as shown by FIG. 7*a*, when the door D2 is closed (when the lock mechanism 36 is in a locking state), the catching parts 52*a* and 52*b* engage with the catching parts 62*a* and 62*b*, respectively. As shown in FIGS. 7*a* and 7*b*, each of the catching parts 52*a* and 52*b* is a projection having a right-facing surface S4 and projecting to the front. The catching parts 52*a* and 52*b* are of the identical shape, and are located in the same place viewed from the upper side. The catching parts 52*a* and 52*b* are located respectively at the upper end and at the lower end of the link 51. When the lock mechanism 36 is in the locking state, as shown by FIG. 7*a*, the catching parts 52*a* and 52*b* are located in the rear of the catching parts 62*a* and 62*b* with the right-facing surfaces S4 in contact with the left-facing surfaces S3 of the catching parts 62*a* and 62*b*. In this state, the catching parts 52*a*, 52*b*, 62*a* and 62*b* prevent the door D2 from pivoting counterclockwise on the shaft 40 (see FIG. 3), that is, keep the door D2 closed.

The lever 50 is a handle for disengagement of the catching parts 52*a* and 52*b* from the catching parts 62*a* and 62*b*. As shown in FIG. 6, the lever 50 is located in the center of the link 51 with respect to the vertical direction, and as shown in FIG. 4, the lever 50 is fixed to the right side (the outer side) of the door D2. As shown by FIG. 7*b*, when a user turns the lever 50 clockwise, the link 51 pivots clockwise. Accordingly, the catching parts 52*a* and 52*b* pivot clockwise on the link 51, and the right-facing surfaces S4 of the catching parts 52*a* and 52*b* slide to the rear and separate from the left-facing surfaces S3 of the catching parts 62*a* and 62*b*. Thereby, the lock mechanism 36 becomes in an unlocking state, and it becomes possible to open the door D2.

In the image forming apparatus 10, in a state where the lock mechanisms 34 and 36 are in the locking states, when the lock mechanism 36 is switched to the unlocking state, the lock mechanism 34 becomes in the unlocking state simultaneously with the unlocking motion of the lock mechanism 36.

More specifically, as shown by FIG. 7*a*, the levers 44 and 50 are in contact with each other when the lock mechanisms 34 and 36 are in the locking states. Then, when a user turns the lever 50 clockwise, the lever 50 pushes the lever 44 clockwise. Thereby, the catching parts 52*a* and 52*b* disengage from the catching parts 62*a* and 62*b*, and further, the catching parts 46*a* and 46*b* disengage from the catching parts 60*a* and 60*b*. Consequently, the lock mechanisms 34 and 36 become in the unlocking states.

In the image forming apparatus 10, also, in a state where the lock mechanisms 34 and 36 are in the unlocking states, when the lock mechanism 36 is switched to the locking state, the lock mechanism 34 becomes in the locking state simultaneously with the locking motion of the lock mechanism 36. The interlock system between the locking mechanisms 34 and 36 is described below.

While the doors D1 and D2 are open, when a user turns the door D2 clockwise on the shaft 41, the door D2 laps over the door D1, and the lever 50 comes into contact with the lever 44. Then, when the user turns the lever 50 clockwise, as shown by FIG. 7*b*, the lever 50 pushes the lever 44 clockwise. Thereafter, when the user turns the lever 50 counterclockwise, as shown by FIG. 7*a*, the catching parts 52*a* and 52*b* engage with the catching parts 62*a* and 62*b*, respectively. Further, the lever 44 is turned counterclockwise by the lever 50, and the catching parts 46*a* and 46*b* engage with the catching parts 60*a* and 60*b*, respectively. In this way, the lock mechanisms 34 and 36 become in the locking states.

Advantages

In the image forming apparatus 10 of the structure above, the secondary transfer roller 14 fixed to the door D1 can be positioned accurately. In the sheet conveying device disclosed by Japanese Patent Laid-Open Publication No. 4-7227, one of the two opposed rollers is placed on the guide, and the roller placed on the guide is pressed against the other of the two rollers. Therefore, the guide receives force via the roller. Then, since the guide is pushed and closed by the door, the force applied to the guide is transmitted to the door. In a recent image forming apparatus, the door is made thin, and therefore, the door is deformable by force. The deformation of the door causes displacement of the guide, which results in displacement of the roller placed on the guide.

On the other hand, the image forming apparatus 10 has the lock mechanism 34 for keeping the door D1, to which the secondary transfer roller 14 is fixed, in the closed position. With this arrangement, when the doors D1 and D2 are closed, the force transmitted from the door D1 to the door D2 is reduced. Accordingly, the door D2 is suppressed from being deformed, and the door D1 is suppressed from displacing while it is closed. Consequently, displacement of the secondary transfer roller 14 fixed to the door D1 can be prevented.

In the image forming apparatus 10, when a user turns the lever 50, the lever 44 turns simultaneously with the turn of the lever 50. Thus, a user can switch both of the lock mechanisms 34 and 36 to and from the locking states and the unlocking states only by handling the lever 50. In this structure, both the door D1 and the door D2 can be locked, and a sheet jam in the conveyance route R1 can be cleared up easily.

Modification

Figure 8:
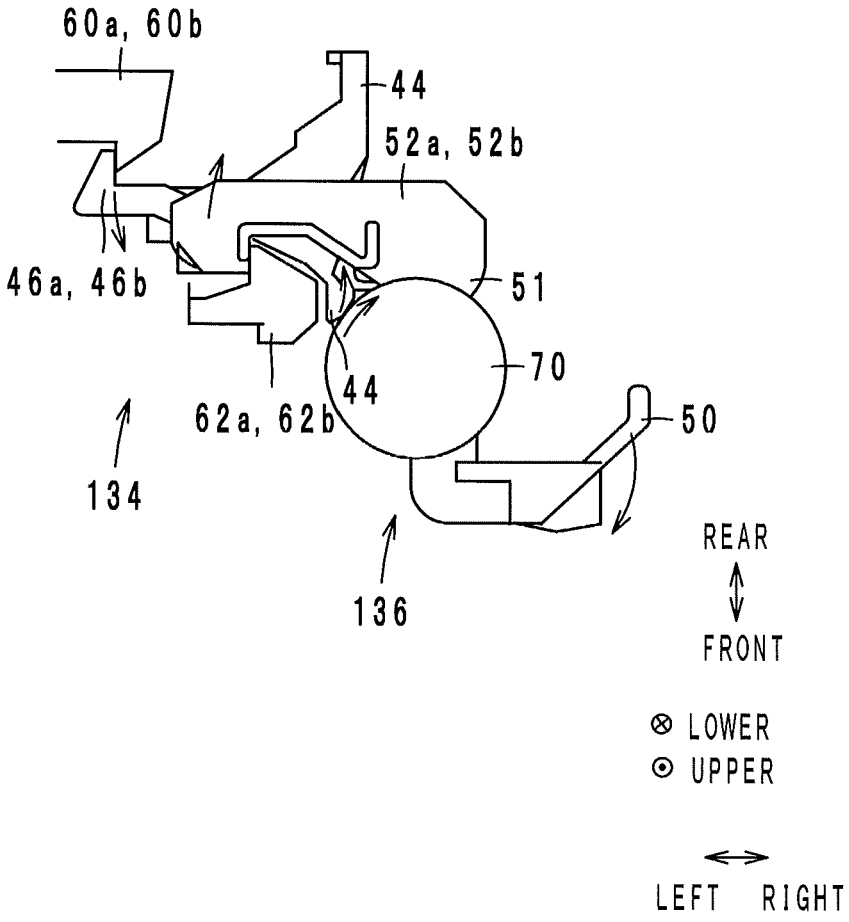
FIG. 8 is a plan view of modified lock mechanisms in locking states.

Next, modified lock mechanisms are described with reference to the drawings. FIG. 8 is a plan view of modified lock mechanisms 134 and 136 in locking states.

The lock mechanism 134 differs from the lock mechanism 34 in the catching parts 46*a*, 46*b*, 60*a* and 60*b*. More specifically, in the lock mechanism 134, the catching parts 46*a* and 46*b* are located in front of the catching parts 60*a* and 60*b*. The lock mechanism 136 differs from the lock mechanism 36 in that a rotating body 70 is provided in the lock mechanism 136. The rotating body 70 is connected to the lever 50 and the catching parts 52*a* and 52*b*.

In the lock mechanisms 134 and 136, when a user turns the lever 50 clockwise, the rotating body 70 and the catching parts 52*a* and 52*b* also turn clockwise. Thereby, the catching parts 52*a* and 52*b* disengage from the catching parts 62*a* and 62*b*.

The rotating body 70 is also in contact with the lever 44. Therefore, when the rotating body 70 turns clockwise, the lever 44 turns counterclockwise. Accordingly, the catching parts 46*a* and 46*b* turn counterclockwise and disengage from the catching parts 60*a* and 60*b*.

In this embodiment, the functional component fixed to the door D1 is the secondary transfer roller 14. However, the functional component fixed to the door D1 may be a roller for conveying a sheet P or may be a sensor for detecting the sheet P. The functional component fixed to the door D1 may be any component to be positioned in the main body 30 by being pushed inward of the main body 30.

Although the present invention has been described in connection with the preferred embodiments above, it is to be noted that various changes and modifications are possible to those who are skilled in the art. Such changes and modifications are to be understood as being within the scope of the invention.

What is claimed is:

1. An image forming apparatus comprising:

a guide that is a component of a conveyance route for a print medium;

a first door that incorporates the guide, an inside of the conveyance route being exposed to an outside of a main body of the image forming apparatus when the first door is open;

a functional component fixed to the first door, the functional component being placed in a specified position by contact with a component located inside the main body when the first door is closed;

a first lock mechanism for keeping the first door closed, wherein the first lock mechanism comprises:

a first catching part formed in the main body;

a second catching part fitted to the first door, the second catching part engaging with the first catching part when the first door is closed; and a first lever for disengagement of the first catching part and the second catching part from each other;

a second door that covers the first door when the second door is closed and that exposes the first door to the outside of the main body when the second door is open; and a second lock mechanism for keeping the second door closed, wherein the second lock mechanism comprises:

a third catching part formed in the main body;

a fourth catching part fitted to the second door, the fourth catching part engaging with the third catching part when the second door is closed; and a second lever for disengagement of the third catching part and the fourth catching part from each other;

wherein a closing motion of the second door in a state wherein both the first door and the second door are open activates the second lock mechanism and the first lock mechanism, whereby the first door is put closed; and wherein when the second lever is handled in a state wherein both the first door and the second door are closed, but the first and second lock mechanisms are not engaged, the third catching part and the fourth catching part are caused to engage with each other, and the first lever is moved by the second lever to cause the first catching part and the second catching part to engage with each other.

2. An image forming apparatus according to claim 1, wherein an opening motion of the second door in a state wherein both the first door and the second door are closed deactivates the second lock mechanism and the first lock mechanism, whereby the first door is put open.

3. An image forming apparatus according to claim 1, wherein when the second lever is handled in a state wherein both the first door and the second door are closed, the third catching part and the fourth catching part are caused to disengage from each other, and the first lever is moved by the second lever to cause the first catching part and the second catching part to disengage from each other.

4. An image forming apparatus according to claim 1, wherein the functional component is a transfer roller for transferring a toner image to the print medium.

5. An image forming apparatus according to claim 1, wherein the first door and the second door pivot about a same axis.

* * * * *